United States Patent [19]

Wagner

[11] Patent Number: 4,964,830

[45] Date of Patent: Oct. 23, 1990

[54] MAGNETIC DEVICE

[76] Inventor: Hans Wagner, 25 Woodale La., Santa Barbara, Calif. 93103

[21] Appl. No.: 443,452

[22] Filed: Nov. 30, 1989

[51] Int. Cl.[5] ..... A63H 33/26; H01F 7/20

[52] U.S. Cl. ..... 446/71; 446/131; 446/135; 335/285

[58] Field of Search ..... 446/129, 131–139, 446/71, 236; 273/239, 1 M, 109, 141 A; 272/8 N, 8 R; 335/285, 219, 302

[56] References Cited

U.S. PATENT DOCUMENTS

| | | | |
|---|---|---|---|
| 3,609,606 | 9/1971 | Podesto | 335/209 |
| 3,714,612 | 1/1973 | Kayle | 335/285 |
| 3,906,658 | 9/1975 | Gross . | |
| 4,022,474 | 5/1977 | Berslow et al. | 446/131 X |
| 4,404,766 | 9/1983 | Toth . | |
| 4,414,775 | 11/1983 | Jensen . | |
| 4,462,596 | 7/1984 | Yamamoto et al. | 273/239 |
| 4,871,340 | 10/1989 | Ross | 446/132 |

*Primary Examiner*—Mickey Yu
*Attorney, Agent, or Firm*—Milton S. Gerstein

[57] ABSTRACT

A magnetic device that may be used for storing and dispensing paper clips, and the like, and which may also be used as an amusement or novelty product. A plastic housing houses a bar magnet with the poles arranged vertically. The bar magnet is positioned near but spaced from the upper surface of the housing by a spacer disc made of magnetizable material. The spacer disc has a central opening, above which opening, on the housing's upper surface, magnetic lines of induction are produced that tend to orient a paper clip, or the like, vertically on end and which also allow for prolonged gyratory motion of the paper clip about the end. A plastic, transparent casing may be provided housing iron powder or tiny magnet bits of different shape, which casing is slidably and rotatably mounted with respect to the upper surface of the housing, so that, as the casing is slid or rotated, different patterns are formed in kaleidoscope-fashion.

20 Claims, 2 Drawing Sheets

FIG. 1
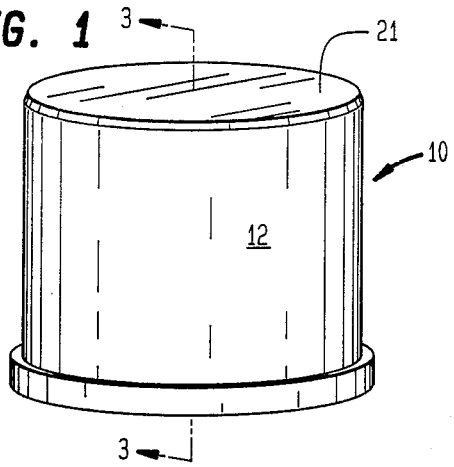
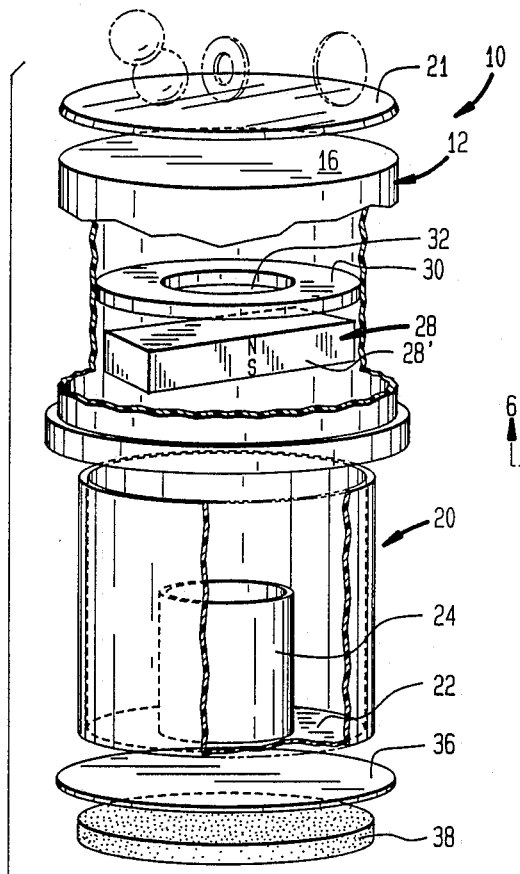
FIG. 2
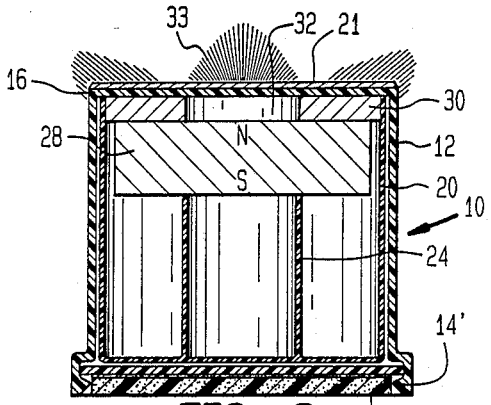
FIG. 3
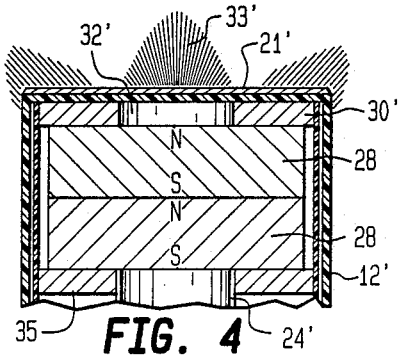
FIG. 4
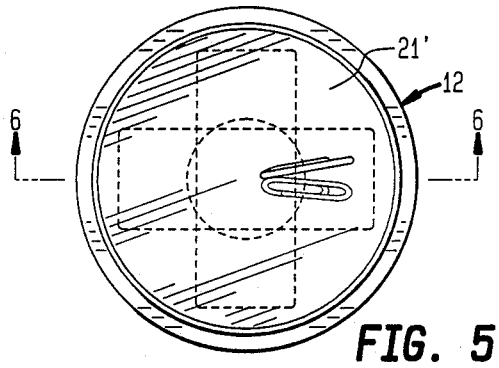
FIG. 5
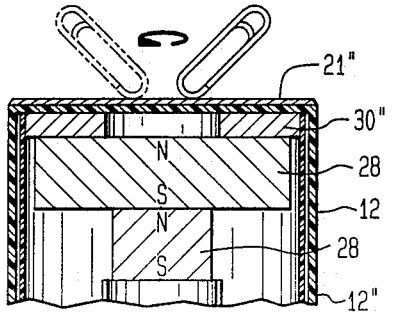
FIG. 6

MAGNETIC DEVICE

BACKGROUND OF THE INVENTION

The present invention is directed to a magnetic device for use in storing and dispensing paper clips, and the like, and which device may also be used as a novelty item and game, which device causes the paper clip, or other magnetizable-material, to stand on end and rotate for an extended period of time after the initial impulse-momentum is applied to the item.

There are many examples of prior-art magnetic devices used for storing magentizable items, for building magnetic sculptures, and the like. Examples of these are shown in the following U.S. Pat. Nos.: 3,609,606-Podesto; 3,714,612-Kayle; 3,906,658-Gross; 4,404,766-Toth; 4,414,775-Jensen; and 4,462,596-Yamamoto. None of these patents, however, teaches the concept of the present invention for allowing a paper clip or other magnetizable item to stand on end and rotate continuously about that end for a sustained period of time.

SUMMARY OF THE INVENTION

It is primary objective of the present invention to provide a magnetic device that may be used in multifarious ways, as a paper-clip storage dispenser, as a novelty device for adults, as an amusement game for children, etc.

It is an objective of the present invention to provide such a magnetic device that will allow for a magnetizable item, such as a paper clip or other lightweight and relatively-thin product, to stand on end and rotate about that end for a sustained period of time after initial impulse-momenta.

Toward these and other ends, the magnetic device according to the invention includes a main housing made of a non-magnetic material such as plastic. Housed therein is at least one bar magnet having its north and south poles arranged vertically, with one pole being spaced from the interior upper surface of the housing via a magnetizable spacer element, preferably circular in shape. This spacer element has a central through-hole formed therein, with the upper surface of the spacer element contacting the interior upper surface of the housing. The combination of spacer element with central through-hole, and a non-magnetizable upper surface of the housing causes a distribution of the magnetic field such that the lines of force thereof cause a magnetizable item, such as a paper clip, to stand on end when positioned on the central portion of the plastic upper surface juxtapositioned over the central through-hole of the spacer element, and also allows for continuous and sustained rotation of the item about the end. The exterior surface of the upper surface of the housing is made of reflective material to enhance the effect. In a modification of the device, a clear plastic casing is rotatably mounted to the upper surface of the housing, in which casing are provided a plurality of tiny or small, differently-shaped magnets, which assume different configurations upon the rotation and agitation of the clear casing, in kaleidoscope-like manner.

BRIEF DESCRIPTION OF THE DRAWING

The invention will be more readily understood with reference to the accompanying rawing, wherein:

FIG. 1 is an isometric view showing the plastic housing for the magnetic device of the present invention, which housing has a reflective upper surface;

FIG. 2 is an assembly view, in perspective, showing the connection of parts of the magnetic device of the invention;

FIG. 3 is a cross-sectional view taken along line 3—3 of FIG. 1;

FIG. 4 is a view similar to FIG. 3 but showing a modification thereof whereby two bar magnets are incorporated;

FIG. 5 is a top view of another modification of the magnetic device of invention in which two bar magnets oriented transverse to each other are used;

FIG. 6 is a cross-sectional view taken along line 6—6 of FIG. 5;

DETAILED DESCRIPTION OF THE INVENTION

Figure 7:
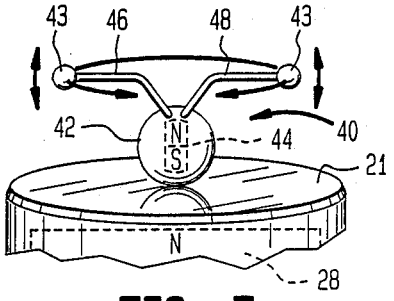
FIG. 7 is a partial isometric view showing the use of a novelty item with the device of the invention, which item includes a plastic ball having a magnetic core, and a pair of arms, which item shows how any magnetizable item stationed at the center of the upper surface will rotate continuously and oscillate in gyratory motion for a sustained period of time after initial impulse-momenta.

Referring now to the drawings in greater detail, and in particular to FIGS. 1–3, the magnetic device of the invention is indicated generally by reference numeral 10. The device 10 includes an outer cylindrical housing 12 made of a nonmagnetic material, such as plastic. The housing 12 defines a lower annular support surface 14 for supporting the device 10, and an upper flat surface 16, to which upper surface is affixed a reflective surface or mirror 21, in the preferred embodiment. The reflective surface may be a glass or plastic mirror, or "MYLAR" plastic having any appropriate logo, decal, or the like printed thereon. An interior mounting frame 20 is provided that is telescopingly-received within the outer housing 12. The frame 20 is generally cylindrical in shape, and has a lower surface 22 from the center of which projects an upstanding post 24. Positioned on the upper surface of the post 24 is a rectangular bar magnet 28, supported on the central post and extending lengthwise along the diameter of the interior of the housing 12. Supported on the upper surface of the bar magnet is a flat, circular-shaped disc 30 made of magnetizable material, such as iron. The disc 30 is provided with a central hole 32 which is juxtapositioned over the central area of the upper surface of the bar magnet, as shown in FIG. 3. As shown in the drawings, the north pole of the bar magnet 28 faces upwardly, while the south pole downwardly, although the opposite may also hold in the device of the invention. What is essential to the present invention is that the poles be arranged relatively vertically, and that a magnetizable disc be provided along with the central through-hole thereof, as well as the nonmagneticd upper surface of the housing, whether or not it includes a reflective layer, so that the central circular surface area of the upper surface 16 or reflective surface 21, which is juxtapositioned above and in alignment with the central opening 32, is associated with a magnetic field defining the lines of induction thereof that defines lines of force 33 (see FIG. 3) tending to cause any item positioned thereon into the vertically-erect position, so that in the case of a paper clip, for example (see FIG. 6), it is caused to stand on-end, and, with a slight impartation of impulse momenta thereto, can be caused to gyrate about the end for a sustained period of time, at the end of which sustained period, the clip will remain on-end. This effect is achieved because the through-opening 32 allows for the lines of force at the central area of the upper surface to be substantially vertically-oriented, with the spacing from the pole of the bar magnet, achieved via the disc 30 itself, reducing the intensity of the magnetic field to a great enough degree such that the arcuate lines of force emanating from the side surfaces 28' of the bar magnet and from north to south poles are not strong enough to cause the collapse of the paper clip, or the like. In the preferred embodiment, for storing and standing on-end the #1 type of paper clip,—the most common size of paper clip—the disc 30 is ¼ inch in thickness when used with a ceramic bar magnet having the following characteristics: Residual induction of 3800 Guass; length of 1.800 inches; thickness of 9/16 inches. The central opening of the disc 30 is approximately ⅞ inches in diameter, with the overall diameter of the disc 30 being 2¼ inches. It is also noted that the inner frame 20 is held in place in the housing 12 via a snapfit between the lower surface 22 of the frame and an annular beaded portion 14' of the lower rim 14. The bottom of the housing is closed off by a plastic disc 36 provided with a layer of foam for holding the housing on a flat surface by increased static friction as well as to prevent damage to the flat surface supporting the housing.

It is possible to use two such bar magnets 28, as shown in FIG. 4, in order to approximately double the magnetic field associated with the device. In the embodiment of FIG. 4, the two bar magnets are arranged parallel to each other and coextensive, with the lower magnet resting upon the upper surface of the post 24'. By using two such bar magnets, items or articles of even greater weight may be accommodated and caused to stand on-end at the center of the upper nonmagnetic surface 21'. In actuality, the magnetic field force lines 33' of the embodiment of FIG. 4 are not twice the strength of the lines 33 of FIG. 3, owing to the greater distance the lower bar magnet is away from the upper surface 21', and owing to the fact that doubling the thickness of a bar magnet does not correlate with the exact doubling of the associated magnetic flux lines. For example, for the bar magnet 28 used alone, a weight of 6 pounds may be held, while for two such bar magnets stacked together, only 11 pounds may be so held. For the device of FIG. 4, larger paper clips may be caused to stand on end at the center area of the upper surface 21'. It has been found that the lines of force 33' are approximately 50% higher than the lines of force 33. In an alternative version of the double-bar magnet modification, the two bar magnets 28 may be extended at right angles to each other, as shown in FIGS. 5 nd 6. The magnetic flux lines at the center of the upper surface 21" will be the same as that shown in FIG. 4, with the arrangement of FIGS. 5 and 6 adding increased forces about the length and periphery of the housing 12" for storing and holding more and heavier-weighted paper clips, or the like. Of course, in the embodiments of FIG. 4–6, the two bar magnets are arranged with the poles thereof similarly positioned, as shown, Also, as shown in FIG. 4, two magnetizable spacer discs or elements 30' and 35 may be provided, the disc 30' mounted above the upper bar magnet, and the lower disc 35 mounted below the lower bar magnet, with the lower disc 35 having a central through-opening large enough to allow for the passage therethrough of the upper portion of the post 24'. Under this arrangement, the central lines of force 33' above the central opening of the upper disc 30', are made higher and more centralized, with these lines being approximately ⅓ higher than the case of only one spacer disc 30', and resembling a pure cone-shape. This two spacer-disc modification may, of course, also be used in the preferred embodiment of FIGS. 1–3.

Figure 8:
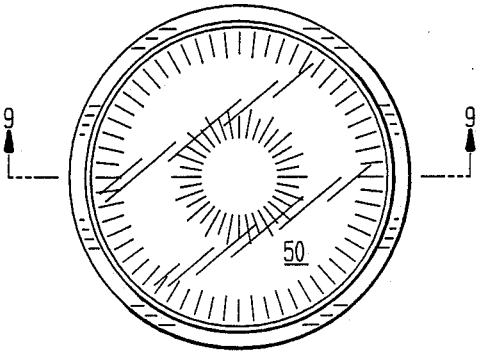
FIG. 8 is a top view of still another embodiment of the invention in which a clear upper casing is provided which houses iron powder mixed with colored nylon powder, by which sliding movement of the clear casing causes the iron and nylon powder to assume different configurations.

FIG. 8 shows a novelty-type of item 40 being held at the center of the upper nonmagnetic reflective surface 21, which item includes a hollow plastic ball 42 of ¾ inch diameter in which is housed a tiny ceramic magnet 44, with, of course, the south pole opposite the north pole of the bar magnet 28 at the center of the upper surface plate 21, so that the ball 42 may be easily rotated for a sustained period of time. Attached to the ball 42, are a pair of bifurcated arms 46, 48 at the ends of which are tiny balls 43, so that as the ball 42, rotates the arms 46, 48 will rotate therewith and also oscillate up-and-down, to achieve a gyratory motion. The distance between the two small 43 is approximately 2 inches.

Figure 9:
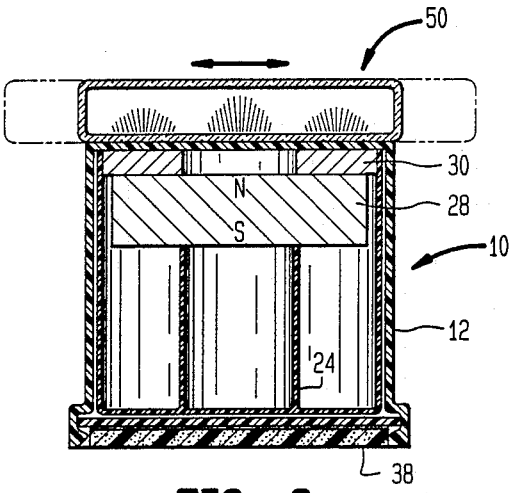
FIG. 9 is a cross-sectional view taken along line 9—9 of FIG. 8.

FIGS. 8 and 9 shows another use of the device of the invention, in which there is provided a circular cross-sectioned sealed, plastic, clear or transparent, casing 50 in which is provided iron fillings or iron powder which may be mixed with dyed nylon powder, to give an appearance of color to the gray iron powder. The casing 50 has approximately the same diametric extent as the upper surface 16 of the housing, and may be slid therealong in order to cause different arrangements or "sculptures" of iron powder, as the casing is slid into differing strengths and orientations of the magnetic field. The casing may also be moved vertically as well as rotated in order to achieve a different "sculpture." In the embodiment shown in FIGS. 8 and 9, the reflective layer or surface 21 may or may not be provided, such not being shown in FIG. 9.

Figure 10:
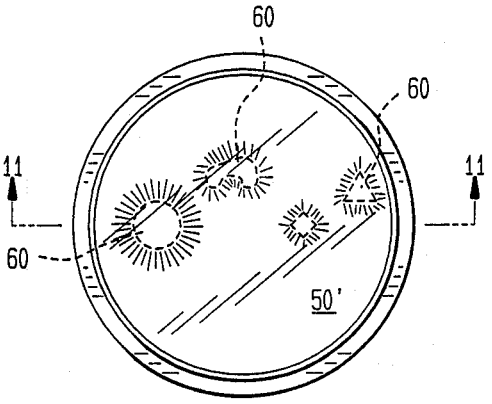
FIG. 10 is a top view of yet another modification of the device of the invention in which the clear plastic casing is rotatably mounted to the upper surface of the housing and in which casing there are provided a plurality of tiny magnets of different shapes, so that when the casing is rotated and agitated, different patterns are formed, in kaleidoscope-like fashion.
Figure 11:
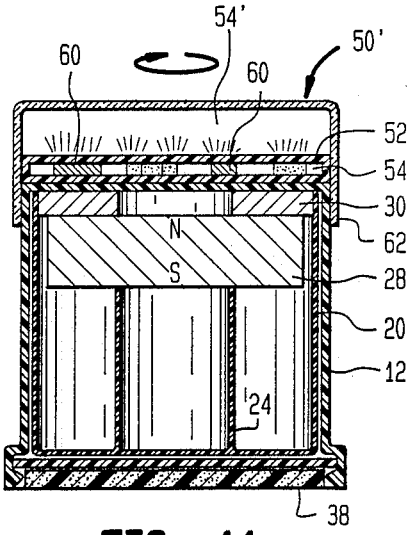
FIG. 11 is a cross-sectional view taken along line 11—11 of FIG. 10.

FIGS. 10 and 11 show a modification of the device of FIGS. 8 and 9 in that there is provided a plastic, clear casing 50' similar to casing 50, but having a transparent, intermediate, horizontal separating partition 52 in order to form, along with the lower surface and side circumferential surface of the casing, a chamber 54 in which are provided a series of differently-shaped, small magnet bits 60. The casing 50' is rotatably coupled to the upper circumferential portion of the housing 12 preferably by a press fit thereover, via the downwardly-projecting annular rim portion 62 formed integrally with the casing 50' proper. Since in the preferred embodiment, the housing 12 and casing 50' are made of flexible plastic, the annular rim 62 is easily telescoped over the upper circumferential surface of the housing 12 with enough clearance between the two adjoining surfaces in order to allow for easy rotation thereof, whereby in kaleidoscope-type manner, an endless array of different patterns and forms may be formed with the tine magnets 60. Also, vertical sliding movement of the casing 50' is also possible thereby. Of course, the rim 62 may be more positively united with the upper circumferential surface of the housing 12, as by an annular bead formed in the lower interior surface of the rim 62 which rides in an annular slot or groove formed in the interior surface of the upper circumferential surface of the housing juxtapositioned thereat, in which case vertical sliding movement is prevented. The thickness of the chamber 54 is such that the tiny magnet bits 60 are allowed free movement therein, and preferably is approximately 0.40 inches. The casing 50' may also be provided with iron powder or filings, in the manner of the casing 50 of FIG. 9, which iron powder is housed in the upper chamber 54'.

It is important that the through-hole of the spacer element be located approximately centrally thereof, so that the area of the upper support surface is also generally centrally located, in order that the magnetic force lines of the magnetic field are generally vertically oriented, with as little effect as possible from the side surfaces of the bar magnet, so that this central area is crossed as little as possible by the arcuate magnetic field force lines originating or terminating at a side surface of the bar magnet. The magnetic dipole u is defined by the vector equation $T=u \times B$, with B being the magnetic induction, and T being the torque created thereby. The magnetic force lines have been described above and shown in FIGS. 1, 3 and 4. According to the present invention, owing to the generally vertical orientation of the force lines at the central area, and the spacing thereof from the magnetic field source via the spacer element, accomplished additionally by the nonmagnetic material of the upper support surface, most of the force lines are vertically oriented, since those of arcuate shape will have already arched away from the central area, thus also causing a type of magnetic sump action, tending to draw or suck in the magnetizable item when such item is located immediately adjacent the perimeter of the central area of the upper support surface.

While a specific embodiment of the invention has been shown and described, it is to be understood that numerous changes and modification may be made therein without departing from the scope, spirit and intent of the invention as set forth in the appended claims. For example, it is within the purview of the present invention to use other means for producing a magnetic field of the dipole-type, such as by a solenoid, etc.

What I claim is:

1. A magnetic device that may be used for storing and dispensing articles, and may be used as an amusement device or toy, comprising:

a main housing made of nonmagnetizable material having a hollow interior;

at least one bar magnet mounted in said interior of said main housing, said bar magnet having a thickness, length and width, a north pole, and a south pole; said bar magnet further comprising an upper surface and a lower surface, said south pole being situated at one of said upper and lower surfaces, and said north pole being situated at the other of said upper and lower surfaces;

said main housing comprising an upper support surface spaced from the upper surface of said bar magnet; said upper and lower surfaces of said bar magnet being related to each other such that said upper surface of said bar magnet lies closer to said upper support surface of said main housing than said lower surface of said bar magnet;

a spacer element made of magnetizable material mounted in said housing between said upper surface of said bar magnet and said upper support surface of said main housing for spacing said bar magnet from said upper support surface; said spacer element having a through-opening formed therein;

said upper support surface of said main housing defining a surface area thereof in alignment with and juxtapositioned over said through-opening of said spacer element, whereby a magnetizable item may be caused to stand on end and caused to gyrate for an extended period of time after initial impulse-momenta are applied thereto.

2. The device according to claim 1, wherein said main mousing is generally circular in cross section, said through-opening being centrally located on said spacer element, and said surface area of said upper support surface also being centrally located.

3. The device according to claim 1, wherein said upper support surface of said main housing further comprises an upper reflective layer made of nonmagnetizable material.

4. The device according to claim 1, wherein said housing comprises an interior, upstanding post having a top flat surface upon which is supported said lower surface of said at least one bar magnet.

5. The device according to claim 2, wherein said spacer element is a disc-shaped element having a thickness less than said thickness of said at least one bar magnet.

6. The device according to claim 5, wherein the thickness of said upper support surface of said main housing is less than said thickness of said disc-shaped element.

7. The device according to claim 1, comprising a first upper bar magnet and a second lower bar magnet, each said bar magnet having an upper and a lower surface, said upper surface of said lower bar magnet contacting against the lower surface of said upper bar magnet, whereby the magnetic flux of the device is increased.

8. The device according to claim 7, wherein said first and second magnets are arranged parallel to each other and coextensive.

9. The device according to claim 7, wherein said first and second magnets are arranged transverse to each other.

10. The device according to claim 9, wherein said main housing and said upper support surface thereof are circular in cross section, and said spacer element is also circular in cross section.

11. The device according to claim 1, comprising another said spacer element mounted in said hollow interior of said main housing and in contact against said lower surface of said at least one bar magnet; said another spacer element also being made of magnetizable material and having a central through-opening thereof.

12. The device according to claim 4, wherein said main housing comprises a first outer section and a second inner section telescopingly received in said first outer section; said second inner section comprising a lower wall portion from which extends upwardly said post from a center portion of said lower wall portion; said second inner section further comprising an outer, circumferential wall extending upwardly from the peripheral surface of said lower wall portion, said outer, circumferential wall having a height greater than the height of said post so that said outer, circumferential wall projects into said the interior of said first outer section a greater distance than said post; said at least one bar magnet and said spacer element being positioned within the portion of said outer, circumferential wall projecting above said top flat surface of said post by which lateral stability is provided; said upper support surface of said main housing being part of said first outer section.

13. The device according to claim 1, further comprising a see-through, enclosed casing, said casing comprising at least one enclosed chamber, and a plurality of magnetizable elements in said chamber; said casing being located on said upper support surface of said main housing for rotational as well as sliding movement relative thereto, said casing and said main housing having cooperating means for mounting said casing for said rotational and sliding movement.

14. The device according to claim 13, wherein said plurality of magnetizable elements comprise at least one of iron powder and small magnet bits.

15. The device according to claim 14, wherein said cooperating means of said casing comprises a downwardly-projecting annular rim for telescoping mounting about the upper circumferential surface of said main housing, whereby said casing is vertically slidable and rotatable relative to said upper support surface, said upper circumferential surface constituting said cooperating means of said main housing.

16. The device according to claim 15, wherein said casing comprises a first lower enclosed chamber, and a second upper enclosed chamber, and a see-through partition wall between said chambers; said small magnet bits being of different shape and being housed in said second lower enclosed chamber.

17. A magnetic device that may be used for storing and dispensing articles, and may be used as an amusement device or toy, comprising:

a main housing made of nonmagnetizable material having a hollow interior;

means for producing a magnetic field mounted in said interior of said main housing, said means for producing a magnetic field having a thickness, length and width, a north pole, and a south pole, and further comprising an upper surface and a lower surface, said south pole being situated at one of said upper and lower surfaces, and said north pole being situated at the other of said upper and lower surfaces;

said main housing comprising an upper support surface spaced from the upper surface of said means for producing a magnetic field; said upper and lower surfaces of said means for producing a magnetic field being related to each other such that said upper surface of said means for producing a magnetic field lies closer to said upper support surface of said main housing than said lower surface of said means for producing a magnetic field;

a spacer element made of magnetizable material mounted in said housing between said upper surface of said means for producing a magnetic field and said upper support surface of said main housing for spacing said means for producing a magnetic field from said upper support surface; said spacer element having a through-opening formed therein;

said upper support surface of said main housing defining a surface area thereof in alignment with an juxtapositioned over said through-opening of said spacer element, whereby a magnetizable item may be caused to stand on end and caused to gyrate for an extended period of time after initial impulse-momenta are applied thereto.

18. The device according to claim 17, wherein said through-opening is centrally located on said spacer element, and said surface are of said upper support surface is also centrally located.

19. A method of magnetically holding magnetizable items such that the items may be stood on end, comprising:

(a) arranging the magnetizable items on a support surface made of nonmagnetizable material;

(b) placing a magnetic-field producing means defining a north pole and a south pole under the support surface such that one of the poles lies closer to the support surface than the other pole;

(c) placing a spacer element having a through-opening made of magnetizable material between the magnetic-field producing means and the support surface;

(d) said step (a) comprising arranging at least one of the magnetizable items on a portion of the support surface directly above and in substantial vertical alignment with at least a portion of the through-opening of the spacer element; and (e) standing at least one of the magnetizable items on end, whereby the magnetic flux lines produced will retain the at least one magnetizable item in its on-end position.

20. The method according to claim 19, further comprising imparting a torque to the at least one magnetizable item to cause it to gyrate in a sustained manner by the magnetic field produced.

* * * * *